US006105834A

United States Patent [19]

Cohen

[11] Patent Number: 6,105,834

[45] Date of Patent: Aug. 22, 2000

[54] GARMENT HANGER WITH DEPENDENT LOOP

[75] Inventor: Bernard J. Cohen, Spring Valley, N.Y.

[73] Assignee: The Accessory Corporation, New York, N.Y.

[21] Appl. No.: 09/064,584

[22] Filed: Apr. 22, 1998

[51] Int. Cl.[7] ..... A47G 25/14

[52] U.S. Cl. ..... 223/88; 223/85

[58] Field of Search ..... 223/88, 85, DIG. 3, 223/DIG. 4; 248/339, 317; 211/118

[56] References Cited

U.S. PATENT DOCUMENTS

| | | | |
|---|---|---|---|
| D. 275,539 | 9/1984 | Mainetti . | |
| 3,952,985 | 4/1976 | Davenport | 248/317 |
| 4,054,234 | 10/1977 | Thomas . | |
| 4,284,219 | 8/1981 | Standel, Jr. | 294/152 |
| 4,416,401 | 11/1983 | King | 223/88 |
| 4,638,930 | 1/1987 | Blanchard . | |
| 4,653,678 | 3/1987 | Blanchard et al. . | |
| 4,871,098 | 10/1989 | Bredeweg et al. . | |
| 5,029,739 | 7/1991 | Blanchard et al. | 223/88 |
| 5,074,445 | 12/1991 | Chen | 223/85 |
| 5,499,789 | 3/1996 | Rose | 248/489 |
| 5,803,321 | 9/1998 | Willinger et al. | 223/88 |

*Primary Examiner*—Bibhu Mohanty
*Attorney, Agent, or Firm*—David P. Gordon; David S. Jacobson; Thomas A. Gallagher

[57] ABSTRACT

A garment hanger having an integrally molded loop for an auxiliary hanger suspended therefrom and in vertical alignment with the garment hanger. The loop has an open chamber defined by a first continuous leg, a second continuous leg, and a connecting element which connects the distal ends of the first and second legs. The hook of the lower or auxiliary hanger is positioned parallel to the upper hanger and easily inserted through the open chamber. Also, the first and second legs serve to secure the lower hanger against unwanted and undesirable rotation.

14 Claims, 3 Drawing Sheets

GARMENT HANGER WITH DEPENDENT LOOP

BACKGROUND OF THE INVENTION

1. Field of the Invention

The present invention relates to hangers. More particularly, the present invention relates to garment hangers for use in situations in which more than one hanger is necessary or desirable to display garments with other related garments. The present invention also has applicability to garment hangers for use in transport of garments.

2. Discussion of the Related Art

U.S. Pat. No. 4,871,098 to Bredeweg et al. entitled "Hook Socket for Ganging Hangers," the disclosure of which is hereby incorporated by reference, discloses a garment hanger having a loop generally indicated as 21 from which a second hanger may be hung. Although useful in certain situations, the Bredeweg hanger suffers from the drawback of not providing entry of the lower hanger in a direction parallel to the face of the upper hanger. As a result, the structure of the Bredeweg hanger may, in use, allow for rotation of the lower hanger. This rotation is undesirable because retailers and others prefer that the lower hanger remain parallel with the upper hanger such that the garments which the hangers support remain neat and aligned.

U.S. Pat. No. 4,653,678 to Blanchard et al. entitled "Ganging Hook for Garment Hangers," the disclosure of which is hereby incorporated by reference, discloses a garment hanger having a loop generally indicated as 20 from which a second hanger may be hung. Although the Blanchard hanger allows for parallel insertion of the lower hanger, an undesirable snapping or jolting force is required to engage and secure the lower hanger in the loop 20.

Thus, these hangers, while functional, provide less than optimal ease of insertion and retention of the lower hanger hook into the loop of the upper hanger. Moreover, due to the relative complexity of the loop structure of these existing hangers, the manufacturing costs of these hangers are unnecessarily high.

SUMMARY OF THE INVENTION

Accordingly, it is an object of the present invention to provide a garment hanging device which provides an improved loop from which a second hanger may be inserted, supported, and retained with increased ease.

It is a further object of the present invention to provide a garment hanging device which may be manufactured at a lower cost than garment hangers of the type heretofore in use.

In accordance with the present invention, a garment hanger is disclosed which includes a body having an upper surface and a lower surface, a hook extending from the upper surface of the body, a loop having a first leg and a second leg, each of the having an end proximate to the lower surface of the body, and an end distal from the lower surface of the body, where the distal ends of said first and second legs extending vertically from the lower surface of the body, the first leg being continuous in a direction from the proximal end to the distal end thereof, and the second leg being continuous in a direction from the proximal end to the distal end thereof, and at least one of the first leg and second leg having a constant thickness from its proximate end to its distal end, the loop further having a connector integrally formed with the distal ends of the legs, wherein the connector and the first and second legs define an open chamber from which the second hanger is capable of being engaged and suspended, the connector having a width, measured in a direction parallel to a face of the garment hanger, greater than at least one of the first and second legs, and extending beyond a leading and trailing edge of the at least one of the first and second legs.

BRIEF DESCRIPTION OF THE DRAWINGS

The above and still further objects, features and advantages of the present invention will become apparent upon consideration of the following detailed description of a specific embodiment thereof, especially when taken in conjunction with the accompanying drawings, wherein.

DETAILED DESCRIPTION OF THE INVENTION

Figure 1:
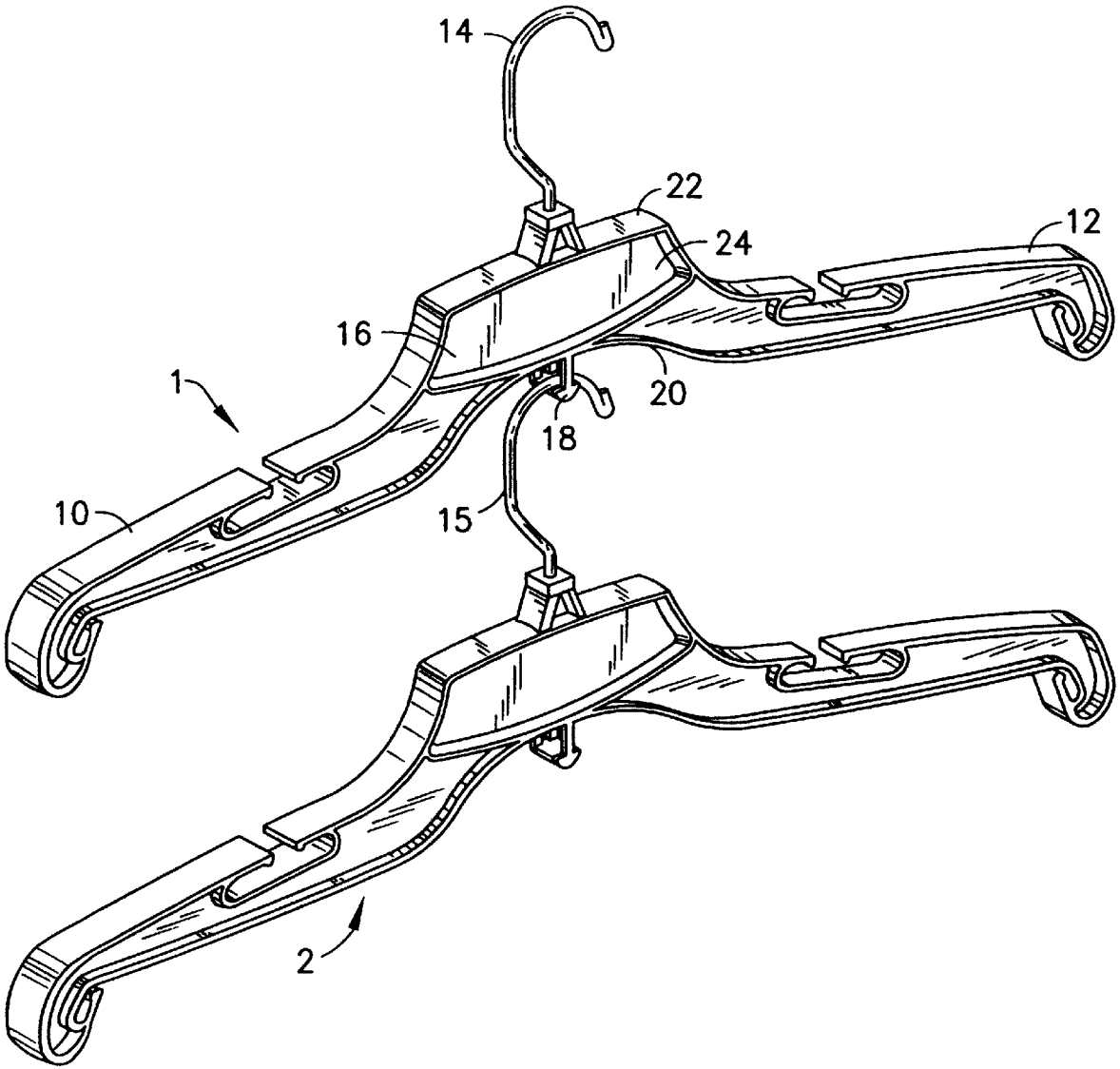
FIG. 1 is a perspective view of a garment hanger employing the loop according to the present invention.

Referring now to FIG. 1, garment hanger 1 has hook 14 and body 16. Further, garment hanger 1 has, according to the present invention, loop 18. Hook 14 extends from upper surface 22 of hanger 1. Garment hanger 1 preferably has a one piece molded body with arms 10, 12 as shown. However, because the arms form no part of the present invention, any appropriate arm type may be used with the loop 18 disclosed herein.

Figure 2:
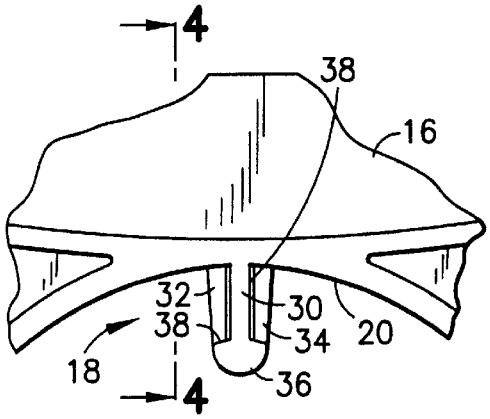
FIG. 2 is a front view of the loop according to the present invention.
Figure 3:
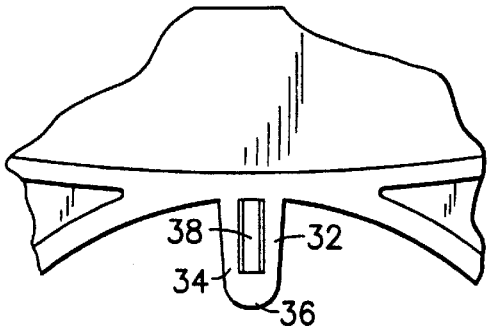
FIG. 3 is a rear view of the loop according to the present invention.
Figure 4:
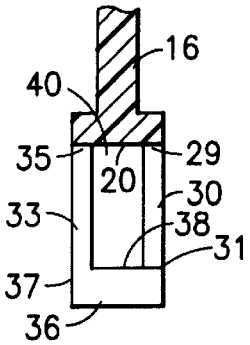
FIG. 4 is a side view of the loop according to the present invention.

As shown for example in FIGS. 2–4, loop 18 projects from lower surface 20 of hanger 1, and is preferably integrally molded with body 16 of hanger 1. Loop 18 has a first or front leg 30 which extends vertically from its end 29 proximate lower surface 20 of body 16, to its distal end 31. Similarly, second or rear leg 33, which includes legs 32 and 34 is optionally separated or divided by slot 38 and extends vertically from its end 35 proximate lower surface 20 of body 16 to its distal end 37. Distal ends 31 and 37 are joined by a connecting element 36. Connector 36 is preferably integrally molded with legs 30 and 33 and body 16.

Connecting element 36 has a top surface 38 which preferably has a convex shape, as shown in FIG. 2. A convex shape is preferable because such a contour substantially corresponds to the shape of hook 15 of lower hanger 2, and thus facilitates the retention of hook 15 within loop 18 as shown, for example, in FIG. 6. However, top surface 38 of connecting element 36 may also have a flat or other shaped surface, consistent with the benefits and advantages of the present invention. Preferably, and as shown for example in FIG. 2, leg 30 is narrower than connecting element 36 in a direction parallel to face 24, i.e., in a direction perpendicular to the length measured between proximal end 29 and distal end 31. Also, it is preferrable that connecting element 36 extend beyond both a leading and trailing edge of at least leg 30, as shown for example in FIG. 2. Such structure not only reduces manufacturing costs by reducing the amount of material required to manufacture the loop, it also facilitates easy insertion of hook 15 of a lower hanger through loop 18, as described below.

As shown in FIG. 4, connecting element 36, and legs 30 and 33 define an open chamber 40. Open chamber 40 is bound at opposite front and back ends by legs 30 and 33. Open chamber 40 is also bound at opposite top and bottom ends by lower surface 16 of hanger 1, and by top surface 38 of connecting element 36. The opposite left and right (or leading and trailing) ends of open chamber 40 are open, thus allowing hook 15 of the lower hanger 2 to pass through loop 18, as shown for example in FIGS. 5 and 6.

Figure 5:
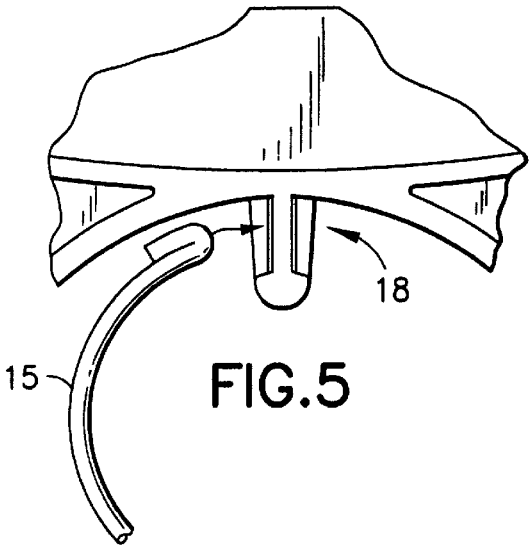
FIG. 5 is a front view of the loop according to the present invention.
Figure 6:
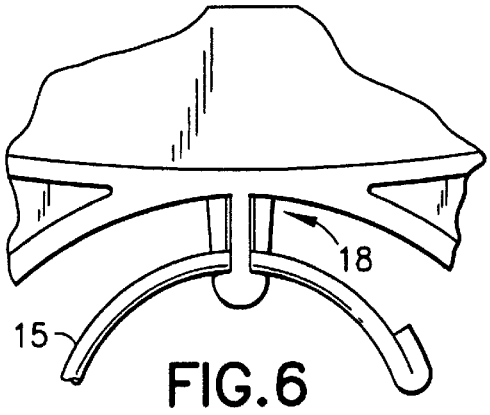
FIG. 6 is a front view of the loop according to the present invention.

In operation, as shown in FIGS. 5 and 6, to suspend lower hanger 2 from upper hanger 1, hook 15 of lower hanger 2 is positioned parallel to upper hanger 1. Hook 15 is then easily inserted through open chamber 40, as shown by the arrow in FIG. 5. The inside concave surface of hook 15 rests snugly against the preferably convex top surface 38 of connecting element 36. Further, the legs 30 and 33 serve to restrain rotation of hook 15 and hanger 2, such that lower hanger 2 remains aligned with, or in the same plane as, upper hanger 1.

Thus, as can be appreciated, the present invention provides increased ease of insertion and retention of lower hanger 2 as compared to prior devices. Further, because the present invention specifically contemplates that the loop 18 be integrally molded with the body 16 of hanger 1, and further because of the relatively straightforward and unadorned structure of loop 18, manufacturing costs may be reduced, as compared to prior devices.

Figure 7:
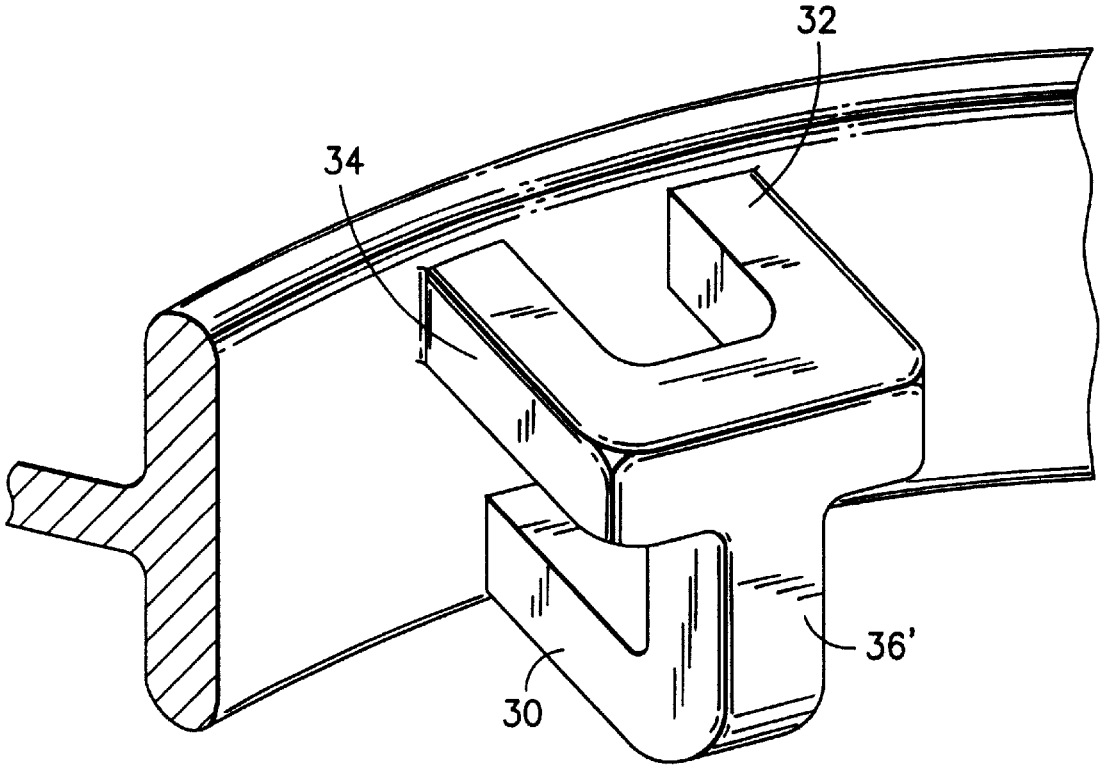
FIG. 7 is a perspective view of an alternate embodiment of the loop according to the present invention.

FIG. 7 shows an alternate embodiment of the present invention. In this alternate embodiment, connecting element 36' is shown with a narrower profile that connecting element 36. Specifically, connecting element 36' is not wider that leg 30, as it was in the previous embodiment. Also, connecting element 36' preferably has a flat bottom surface. This illustrated embodiment provides yet further increased manufacturing efficiencies—and a corresponding further reduction in manufacturing expenses.

Having described the present invention relating to a new and improved garment hanging device, it is believed that other modifications, variations and changes will be suggested to those of skill in the art in view of the teachings set forth herein. It is, therefore, to be understood that all such modifications, variations and changes are believed to fall within the scope of the present invention as defined by the claims appended hereto.

What is claimed is:

1. A garment hanger capable of engaging and suspending therefrom a second hanger having a hook, said garment hanger comprising:

a) a body having an upper surface and a lower surface;

b) a hook extending from said upper surface of said body;

c) first and second legs each having an end proximate to said lower surface of said body, and an end distal from said lower surface of said body, said distal ends of said first and second legs extending vertically from said lower surface of said body, said first leg being continuous in a direction from said proximal end to said distal end thereof, and said second leg spaced from said first leg and continuous in a direction from said proximal end to said distal end thereof, said first leg and said second leg defining a first vertical slot which is perpendicular to a face of said garment hanger; and d) a connector extending vertically from said lower surface of said body and integrally formed with said distal ends of said first and second legs, wherein said connector is spaced from said first and second legs in a direction perpendicular to said face of said garment hanger, and is substantially centered relative to said first vertical slot in a direction parallel to said face of said garment hanger such that said connector and said first and second legs define an open chamber from which said hook of the second hanger is capable of being engaged and suspended in a direction parallel to said face of said garment hanger but is prevented from being engaged and suspended in a direction perpendicular to said face of said garment hanger.

2. The garment hanger according to claim 1, wherein said connector has a first portion which extends vertically from said lower surface of said body, said first portion having a width measured in a direction parallel to said face of said garment hanger, wherein said width is approximately equal to a width of said vertical slot.

3. The garment hanger according to claim 1, wherein said body, said first and second legs, and said connector are integrally molded.

4. The garment hanger according to claim 1, wherein said hook and said first and second legs and said connector are substantially vertically aligned.

5. The garment hanger according to claim 1, wherein said connector has a width, measured in a direction parallel to a face of said garment hanger, greater than a width of one of said first and second legs.

6. The garment hanger according to claim 1, wherein at least one of said first leg and said second leg has a constant thickness from its proximate end to its distal end.

7. The garment hanger according to claim 1, wherein said connector has a convex top surface.

8. The garment hanger according to claim 1, wherein said connector has a flat top surface.

9. The garment hanger according to claim 1, wherein said connector includes a first portion which extends vertically from said lower surface of said body and a second distal portion substantially perpendicular to said first portion, and said vertical slot extends from said lower surface of said hanger to said second portion of said connector.

10. The garment hanger according to claim 1, wherein said open chamber is substantially rectangular.

11. The garment hanger according to claim 1, wherein said second width is greater than a width of at least one of said first and second legs measured in a direction parallel to said face of said garment hanger.

12. The garment hanger according to claim 1, wherein said open chamber i substantially rectangular.

13. A garment hanger capable of engaging and suspending therefrom a second hanger, said garment hanger comprising:

a) a body having an upper surface and a lower surface;

b) a hook extending from said upper surface of said body;

c) a first solid leg and a second solid leg spaced from said first solid leg and defining a vertical slot therebetween, said first and second legs each having an end proximate to said lower surface of said body, and an end distal from said lower surface of said body, said distal ends of said first and second legs extending vertically from said lower surface of said body; and d) a solid connector centered between said first and second vertical legs and having a proximal end coupled to said lower surface of said body, said proximal end having a first width measured parallel to a face of said hanger, said first width being substantially equal to a width of said vertical slot, said connector having a distal end integrally formed with said distal ends of said first and second legs and having a second width measured parallel to said face of said hanger greater than said first width, wherein said connector and said first and second legs define an open chamber from which said second hanger is capable of being engaged and suspended, wherein a hook of said second hanger may be inserted at least partially through said open chamber such that said second hanger is suspended from said connector and that in order to suspend said second hanger from said connector said hook of said second hanger is inserted through said open chamber in a direction parallel to a face of said garment hanger.

14. A garment hanger capable of engaging and suspending therefrom a second hanger, said garment hanger comprising:

a) a body having an upper surface and a lower surface;

b ) a hook extending from said upper surface of said body;

c) a first solid leg and a second solid leg spaced from said first solid leg and defining a vertical slot therebetween, said first and second legs each having an end proximate to said lower surface of said body, and an end distal from said lower surface of said body, said distal ends of said first and second legs extending vertically from said lower surface of said body; and d) a solid connector having a proximal end coupled to said lower surface of said body, said proximal end having a first width measured parallel to a face of said hanger, said connector having a distal end integrally formed with said distal ends of said first and second legs and having a second width measured parallel to said face of said hanger greater than said first width, wherein said connector and said first and second legs define an open chamber from which said second hanger is capable of being engaged and suspended, wherein a hook of said second hanger may be inserted at least partially through said open chamber such that said second hanger is suspended from said connector and that in order to suspend said second hanger from said connector said hook of said second hanger is inserted through said open chamber in a direction parallel to a face of said garment hanger, and wherein said connector is centered between said first and second vertical legs such that a hook of said second hanger cannot be inserted through said open chamber in a manner perpendicular to said face of said garment hanger.

* * * * *